United States Patent [19]

Streb et al.

[11] Patent Number: 4,805,836

[45] Date of Patent: Feb. 21, 1989

[54] DEVICE FOR THE THERMAL SPRAY APPLICATION OF WELDING MATERIALS

[75] Inventors: Karl-Peter Streb, Markt Mömbris; Uwe Szieslo, Waldems; Manfred Oechsle, Bad Homburg, all of Fed. Rep. of Germany

[73] Assignee: Castolin S.A., Lausanne, Switzerland

[21] Appl. No.: 60,100

[22] Filed: Jun. 9, 1987

[30] Foreign Application Priority Data

Jun. 16, 1986 [DE] Fed. Rep. of Germany ..... 3620183
Jun. 16, 1986 [DE] Fed. Rep. of Germany ..... 3620201

[51] Int. Cl.[4] ..... B05B 1/24
[52] U.S. Cl. ..... 239/80; 239/587
[58] Field of Search ..... 239/79–85, 239/587

[56] References Cited

U.S. PATENT DOCUMENTS

| | | | |
|---|---|---|---|
| 2,975,805 | 3/1961 | Horn | 239/587 X |
| 3,112,072 | 11/1963 | Malore | 239/79 |
| 4,343,605 | 8/1982 | Browning | 239/79 X |
| 4,363,443 | 12/1982 | Huehne | 239/79 |
| 4,540,121 | 9/1985 | Browning | 239/79 |
| 4,548,019 | 2/1986 | Browning | 239/80 |
| 4,711,627 | 12/1987 | Oechsle et al. | 431/30 |

FOREIGN PATENT DOCUMENTS

| | | | |
|---|---|---|---|
| 9794 | 3/1928 | Australia | 239/83 |
| 0135826 | 4/1985 | European Pat. Off. | 239/79 |
| 0136978 | 4/1985 | European Pat. Off. | 239/79 |
| 8500991 | 3/1985 | PCT Int'l Appl. | 239/81 |

*Primary Examiner*—Andres Kashnikow
*Assistant Examiner*—Marybeth O. Jones
*Attorney, Agent, or Firm*—Kurt Kelman

[57] ABSTRACT

A device for the thermal spray application of welding materials comprises a jet focussing nozzle having an axis and defining an elongated, axially extending jet focussing channel having a feed-in end, and a burner nozzle in the pinch nozzle for directing a flame into the feed-in end. The jet focussing nozzle is divided into two connected parts along a plane extending transversely to the jet focussing nozzle axis in the area of the feed-in end and dividing the jet focussing nozzle into a front part and a rear part receiving the burner nozzle, and the front nozzle part is adjustable with respect to the rear part between an operating position wherein the nozzle parts have contacting end faces in this plane and the jet focussing channel extends continuously through the nozzle parts, and an ignition position wherein the front part clears the burner nozzle for access thereto.

11 Claims, 2 Drawing Sheets

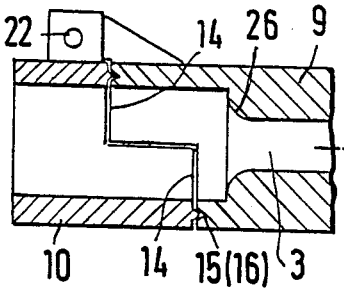
FIG. 3
FIG. 4
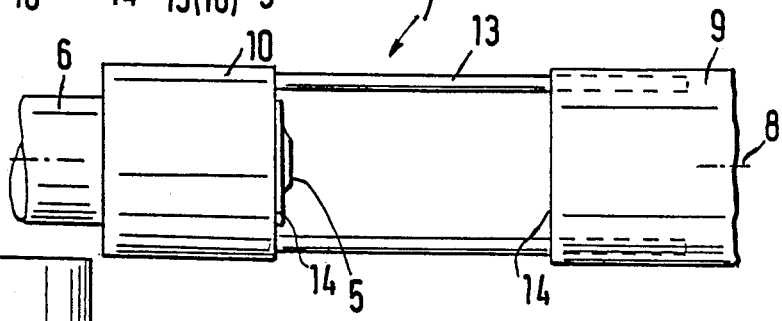
FIG. 6
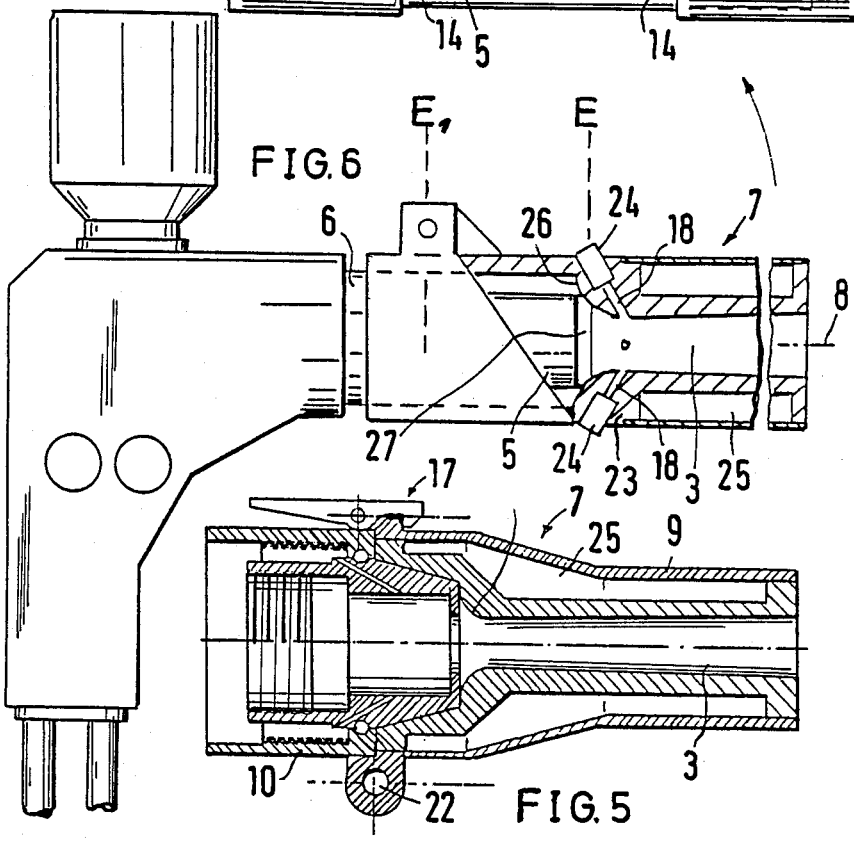
FIG. 5

DEVICE FOR THE THERMAL SPRAY APPLICATION OF WELDING MATERIALS

BACKGROUND OF THE INVENTION

(1) FIELD OF THE INVENTION

The present invention is concerned with a device for the thermal spray application of welding materials, comprising a jet focussing nozzle and a burner nozzle disposed therein at its feed-in end.

(2) DESCRIPTION OF THE PRIOR ART

Devices of the afore-described type for the thermal spraying of coatings of powder are disclosed in U.S. Pat. No. 4,711,627. They work with low spray losses and, operating in accordance with the so-called differential pressure principle, on the one hand, do not require more, or not much more, in terms of structural components than has so far been necessary for flame spraying and, on the other hand, through proportionate adjustability of the combustion chamber, permit the use of all combustible gases, particularly including the use of acetylene and, to a limited extent, also permit the processing of different spray powders. They also make it possible to carry out ignition or start-up procedures with safety, requiring, however, employment of a relatively complex switching sequence and a corresponding switching mechanism. For, it is imperative for the safe ignition start-up of the state-of-the-art device, and hence, for the serviceability of this device, in general, to carry out ignition in the following steps to reduce the combustible gas-oxygen mixture to a minimum for the start-up phase: scavenging with pure oxygen; making the ignition device ready for operation and only then feeding-in the combustion gas. If this order of sequence were not followed, it would lead immediately ahead of the nozzle to a dangerous explosion when the ignition is switched on, or at least to an explosion with a quenching of the flame. Admittedly, this operational sequence essential for the start-up phase could be manipulated by hand but this would be too bothersome and also too unsafe.

SUMMARY OF THE INVENTION

It is, therefore, the object of the present invention to improve the device of the afore-mentioned type so that its electrical ignition and switching mechanism are no longer required, i.e., the device can be ignited in a conventional manner while precluding an explosion risk and the disadvantages involved in a quenching of the flame.

The above object is accomplished according to this invention with a device for the thermal spray application of welding materials, which comprises a jet focussing nozzle having an axis and defining a combustion chamber and an elongated, axially extending jet focussing spray channel having a feed-in end in communication with, and adjacent, the combustion chamber for receiving combustion gases therefrom, and a burner nozzle receiving a controlled amount of combustion components and arranged to deliver the combustion components into the combustion chamber. The jet focussing nozzle is divided into two connected parts along a plane extending transversely to the jet focussing nozzle axis in the area of the feed-in end and dividing the jet focussing nozzle into a front part and a rear part into which the burner nozzle extends, and the front jet focussing nozzle part is adjustable with respect to the rear part between an operating position wherein the jet focussing nozzle parts have contacting end faces in this plane and the jet focussing channel extends continuously through the jet focussing nozzle parts, and an ignition position wherein the front part clears the burner nozzle for access thereto whereby the combustion components may be manually ignited and the resultant flame is focussed in the front jet focussing nozzle part upon adjustment thereof into the operating position.

Thanks to the construction of the device according to the invention, ignition may be effected by hand, precluding the afore-mentioned risks and disadvantages, simply by removing the front part of the jet focussing nozzle from the other part thereof, thereby clearing the burner nozzle and, after ignition and adjustment of the flame, restore the front part of the jet focussing nozzle into its operating position. In a preferred embodiment, the front part of the jet focussing nozzle can be simply pivoted away from the burner nozzle and restored into its operating position. Apart from enabling the ignition to be effected simple and safely by hand and doing away with an electrical ignition circuit to the device, the construction of the device according to the invention has the additional advantage that the front part of the jet focussing nozzle is readily replaceable by another jet focussing nozzle front part, for example, one that is of an extended length or in which the jet focussing nozzle channel is of a different configuration, depending on the powders to be processed. It should be noted that the other part may be displaceable relative to the burner nozzle and the nozzle holder, according to U.S. Pat. No. 4,711,627, i.e. suitable measures are required which, on the one hand, insure such displaceability and, on the other hand, safeguard that the other part cannot readily separate from the nozzle holder. Replaceable front parts of the jet focussing nozzle are not required to be of such an adapter-type configuration but require only detachable pivotable or the like connecting and matching end faces of the two parts.

The adjustability of the jet focussing nozzle front part for clearing the burner nozzle for the purpose of ignition by hand can be realized also by axially displaceably mounting the front part on guides extending parallel to the longitudinal axis of the jet focussing nozzle. At least one guiding rod extending parallel to the longitudinal axis of the nozzle may be affixed to one of the jet focussing nozzle parts and engage a correspondingly profiled longitudinal guide track on the other part so that the jet focussing nozzle front part is longitudinally adjustable parallel to the longitudinal axis of the jet focussing nozzle. As this still requires a certain amount of protection, the pivotal adjustment embodiment is the preferred one. For, it should be noted that, with a full operating gas pressure already prevailing during ignition to avoid the use of expensive additional structures, a relatively long flame is generated but is not yet focussed to form a tight flame jet. Thus, focussing is produced only by the front part of the jet focussing nozzle. Therefore, an axially adjustable jet focussing nozzle front part has to carry a handle of corresponding length to permit re-connection of the front part to the other part of the jet focussing nozzle with no danger to the guiding hand.

The division of the jet focussing nozzle into two parts adjustable relative to one another does not impede the cooling of the device and, unless separate cooling circuits are provided for the two parts, all that needs to be done is a suitable connection to be established between the two parts for the coolant.

BRIEF DESCRIPTION OF THE DRAWING

The device of the invention will now be described in more detail with reference to now preferred embodiments thereof, taken in conjunction with the accompanying, partially diagrammatic drawing wherein

FIG. 3 is a fragmentary section through the device according to FIG. 1 in the area of the separating surface;

FIG. 4 is a plane view of another embodiment of the device;

FIG. 5 is a sectional view of an embodiment of a two-part jet focussing nozzle, and FIG. 6 is a partially sectional view of another embodiment of a flame spray gun/jet focussing nozzle combination.

DESCRIPTION OF PREFERRED EMBODIMENTS

Figure 1:
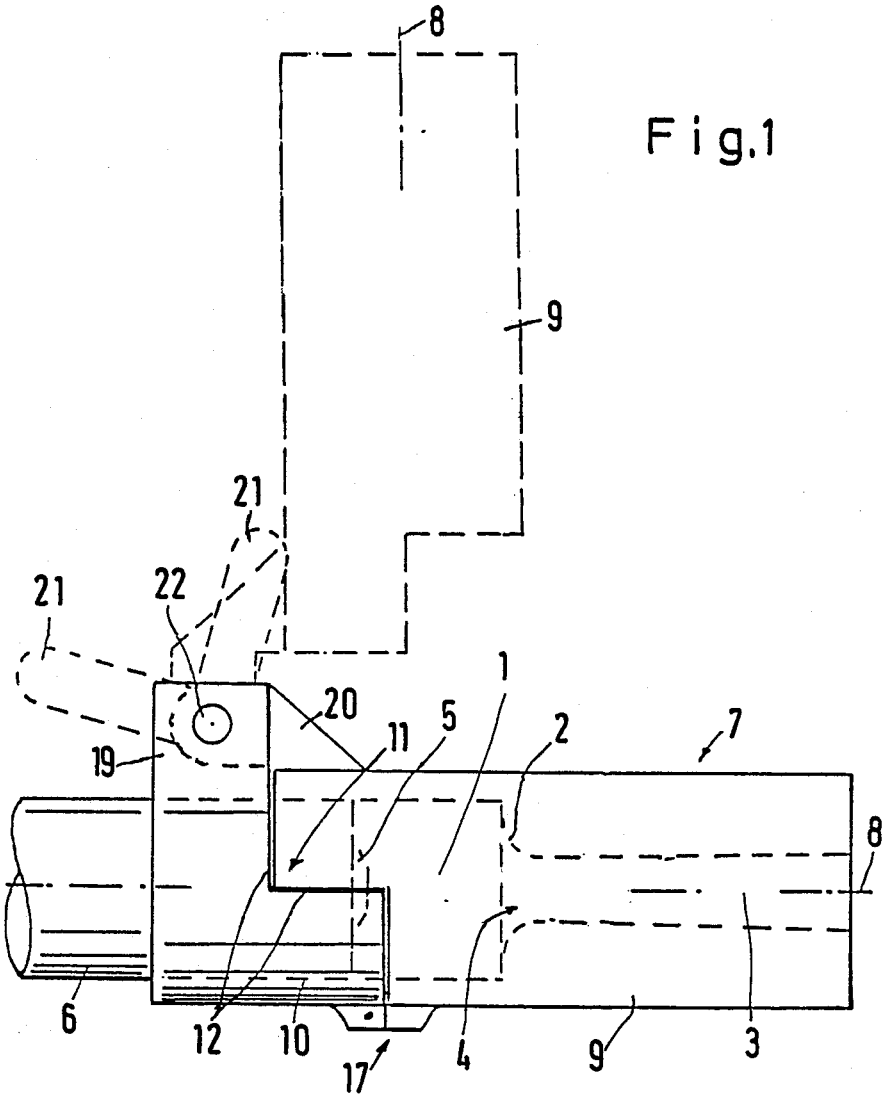
FIG. 1 is a side view of one embodiment of the device including a pivotal connection between the two parts of the jet focussing nozzle.

FIGS. 1 to 4 do not show the structural configuration for the cooling of the device. The elements for the controlled feed-in of the operating gases suitably located on the part of the nozzle holder (not shown) have not been depicted either. The feed-in means of the powder to be sprayed, in known manner, can be effected through a central powder feed-in channel (not shown) in the nozzle holder 6 and burner nozzle 5, respectively. Also, as will be explained in greater detail below, it is possible to introduce the powder directly from the outside into the inlet of the jet focussing nozzle channel 3. The nozzle holder 6, incidentally, can be a conventional flame spray gun onto the cylindrical part of which is pushed part 10 of the jet focussing nozzle 7 to be suitably fixed thereon in a detachable and axially adjustable manner.

As shown in FIG. 1, the device comprises a jet focussing nozzle 7 including an enlarged space defining combustion chamber 1 on its feed-in side to receive a controlled supply of the combustion, a tapered transition zone 2 leading from the combustion chamber to the jet focussing nozzle channel 3. Burner nozzle 5, which may be part of nozzle holder 6, is axially displaceable relative to inlet opening 4 of the jet focussing nozzle channel 3 in combustion chamber 1. As shown, the jet focussing nozzle 7, in the area of the combustion chamber 1, is divided transverse of the longitudinal axis 8 of the nozzle into two parts, and the front part 9 of the nozzle is adjustable relative to the other part 10, which is arranged on the burner nozzle 5 of nozzle holder 6.

Figure 2:
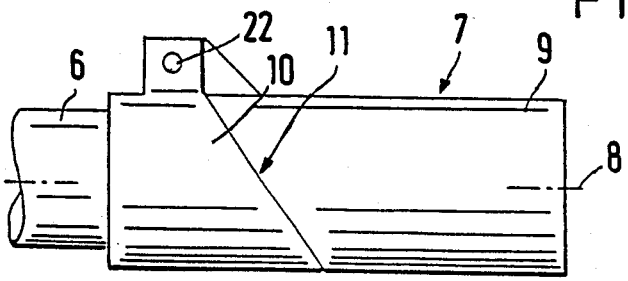
FIG. 2 is a side view of another embodiment of the device including an alternative configuration of the separating surface.

In the preferred embodiments according to FIGS. 1 and 2, adjustability is realized by a pivotable association of the front part 9 of the jet focussing nozzle with the other part 10. Jet focussing nozzle part 10 has a lateral extension 19, and pivotable extension 20 of jet focussing nozzle front part 9 is mounted on lateral extension 19 by a separable joint 22 for easy replacement of the front part. Advantageously, the pivotable extension 20 is provided with a handle 21, as shown in broken lines in FIG. 1, to facilitate the pivotal adjustment movement of front part 9. A spring (not shown) may be provided to hold the front part 9 of the jet focussing nozzle in the operating position. As shown in FIG. 1, the separating plane 11 between parts 9 and 10 may be in the form of a step 12; it may also be inclined, preferably at an angle between 45° and 90°, as illustrated in FIG. 2. If required, the contacting end face 14 of parts 9, 10 are provided with sealing profiles 15 and/or with a fire-resistant sealant 16, as shown in FIG. 3. However, sealing measures of this type would only be required if the outermost operating position of the nozzle holder 6 would extend into the area of the separating plane 11. In order to enable the front part 9, according to the embodiment of FIGS. 1 and 2, to be pivoted upwardly, the nozzle holder 6 and its burner nozzle 5 will, of course, have to be retracted to such an extent as to enable the front part 9 containing the combustion chamber 1 to be pivoted. Under consideration of operating positions of the nozzle holder 6, wherein the holder does not engage the front part 9 of the jet focussing nozzle, locking elements 17 are disposed on parts 9, 10 in the area of the separating plane 11, as shown in FIG. 1. In the embodiment according to FIG. 4, the adjustability of the two parts 9, 10 is realized in a manner such that two suitably profiled guides 13 are rigidly connected to part 10, extending in parallel to the longitudinal axis 8 of the jet focussing nozzle. The front part 9 of the jet focussing nozzle is slidably displaceably disposed on guides 13 so that—as shown—burner nozzle 5 can be forwardly cleared by axial displacement of the front part 9. Since the available ignition gas volume should be held to a minimum during ignition, the separating plane extends through the combustion chamber in this embodiment, i.e. the major portion of the combustion chamber 1 and the transition zone 2 are defined by front part 9 of the jet focussing nozzle, apart from the fact that this is also advantageous in the manufacture of the device. FIG. 5 is a sectional view of a commercial embodiment of the jet focussing nozzle 7 in which corresponding parts bear identical reference numerals. The burner nozzle 5 and the nozzle holder 6 on which the jet focussing nozzle is mounted, for example by way of screwing, are not shown. Also, FIG. 5 shows that the jet focussing nozzle 7 is equipped with a jacket 25 through which a coolant flows to keep the nozzle cool. The line connections required for the cooling fluid are not shown.

As mentioned hereinabove and shown in FIG. 6, powder feed-in need not be effected through the burner nozzle 5 but the powder may be supplied through inlet bores 18 in the front part 9 of the jet focussing nozzle in the area of connection to the other part 10. This will enhance the range of application of the device as regards different types of powder. It is essential that the adjustability of the burner nozzle within the jet focussing nozzle tube, and the adjustability of the latter as described hereinabove, are assured also in connection with the capability of an external powder supply to the jet focussing nozzle tube which, hitherto, has not been employed with such jet focussing nozzles. The reason for this, in all probability, is that only the "pinch effect" has been considered, and it was not recognized that such an external powder supply directly into the jet focussing nozzle tube provides a substantially enhanced capability for adapting the device to different types of powder.

As shown in FIG. 6, four inlet bores 18 provided with feed-in connections 24 are arranged in wall 23 of the adjustable front part of jet focussing nozzle 7 and are convergingly inclined in the outlet direction immediately ahead of the area of the maximum push-in position E of the burner nozzle 5. These inlet bores 18 can also serve as feed-in channels for supplemental gases, such as air, combustion gases, inert gases and even for liquid fuels of high calorific value. Also, it is possible with an adequate number of inlet bores 18 to use some of them for the powder feed-in and others for the supplemental gas supply. Thanks to the axial adjustability of the burner nozzle 5 by the nozzle holder 6, it is readily possible to adjust the nozzle 5 between maximum push-in position E and minimum push-in position $E_1$. This, advantageously, provides different positioning capabilities of the burner flame to the outlets of the inlet bores 18. In this embodiment, the front part adjustability of FIG. 4 is preferred as the feed-in connections 24 would to a certain extent impede pivoting of the front part.

We claim:

1. A device for the thermal spray application of welding materials, which comprises (a) a jet focussing nozzle having an axis and defining a combustion chamber and an elongated, axially extending jet focussing spray channel having a feed-in end in communication with, and adjacent, the combustion chamber for receiving combustion gases therefrom, and (b) a burner nozzle connected to said combustion chamber and receiving a controlled amount of combustion components and arranged to deliver the combustion components into the combustion chamber, (1) the jet focussing nozzle being divided into two connected parts along a plane extending transversely to the jet focussing nozzle axis in the area of the feed-in end and dividing the jet focussing nozzle into a front part and a rear part into which the burner nozzle extends, and (2) the front nozzle part being adjustable with respect to the rear part between an operating position wherein the nozzle parts have contacting end faces in said plane and the jet focussing channel extends continuously through the nozzle parts, and an ignition position wherein the front part clears the burner nozzle for access thereto whereby the combustion components may be manually ignited and the resultant flame is focussed in the front nozzle part upon adjustment thereof into the operating position.

2. The device of claim 1, wherein the front nozzle part is pivotally adjustably hinged to the rear part.

3. The device of claim 2, wherein the dividing plane extends at an angle of 45° to 90° to the jet focussing nozzle axis.

4. The device of claim 2, wherein the dividing plane defines a step.

5. The device of claim 2, further comprising a laterally extending bearing on the rear nozzle part, a bracket on the front nozzle part and a pivot means mounting the bracket on the bearing.

6. The device of claim 1, further comprising guide means for axially displaceably mounting the front nozzle part with respect to the rear nozzle part for adjusting the front part parallel to the jet focussing nozzle axis with respect to the burner nozzle.

7. The device of claim 1, further comprising sealing profiles on the end faces of the nozzle parts.

8. The device of claim 1, further comprising heat-resistant sealant means at the end faces of the nozzle parts.

9. The device of claim 1, further comprising locking elements on the nozzle parts in the range of the dividing plane.

10. The device of claim 1, further comprising a handle on the adjustable front nozzle part.

11. The device of claim 1, further comprising welding material feed-in bores in the front nozzle part leading into the jet focussing channel, the feed-in bores being arranged adjacent the dividing plane.

* * * * *